US006289801B1

(12) United States Patent
Raymond

(10) Patent No.: US 6,289,801 B1
(45) Date of Patent: Sep. 18, 2001

(54) FACE PAINTING STENCILS

(76) Inventor: Patrick M. Raymond, 11 Candice St., Clinton, MA (US) 01510

( * ) Notice: Subject to any disclaimer, the term of this patent is extended or adjusted under 35 U.S.C. 154(b) by 0 days.

(21) Appl. No.: 09/078,709

(22) Filed: May 14, 1998

(51) Int. Cl.[7] ..... B41F 15/00
(52) U.S. Cl. ..... 101/114; 101/127
(58) Field of Search ..... 101/114, 127, 101/129, 115; 132/319; 2/206

(56) References Cited

U.S. PATENT DOCUMENTS 1,812,425 * 6/1931 Wosse ..... 101/127
1,818,863 * 8/1931 Petnel ..... 101/127
2,033,139 * 3/1936 Jefferis ..... 132/319
3,633,286 * 1/1972 Maurer ..... 35/26

* cited by examiner

*Primary Examiner*—Edgar Burr
*Assistant Examiner*—Minh H. Chau

(57) ABSTRACT

A new face painting stencils for helping paint images, logos and other designs on the face of a user. The inventive device includes a card having substantially planar first and second surfaces, a pair of end edges and a pair of side edges extending between the end edges of the card. The card has at least one hole therethrough extending between the first and second surfaces of the card.

5 Claims, 2 Drawing Sheets

FACE PAINTING STENCILS

BACKGROUND OF THE INVENTION

1. Field of the Invention

The present invention relates to face painting tools and accessories and more particularly pertains to a new face painting stencils for helping paint images, logos and other designs on the face of a user.

2. Description of the Prior Art

The use of face painting tools and accessories is known in the prior art. More specifically, face painting tools and accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art face painting tools and accessories include U.S. Pat. No. 5,186,190; U.S. Pat. No. 4,957,124; U.S. Pat. No. 4,886,079; U.S. Pat. No. 3,211,146; U.S. Pat. No. 1,923,340; and U.S. Pat. No. 5,460,087.

While these devices fulfill their respective, particular objectives and requirements, the aforementioned patents do not disclose a new face painting stencils. The inventive device includes a card having substantially planar first and second surfaces, a pair of end edges and a pair of side edges extending between the end edges of the card. The card has at least one hole therethrough extending between the first and second surfaces of the card.

In these respects, the face painting stencils according to the present invention substantially departs from the conventional concepts and designs of the prior art, and in so doing provides an apparatus primarily developed for the purpose of helping paint images, logos and other designs on the face of a user.

SUMMARY OF THE INVENTION

In view of the foregoing disadvantages inherent in the known types of face painting tools and accessories now present in the prior art, the present invention provides a new face painting stencils construction wherein the same can be utilized for helping paint images, logos and other designs on the face of a user.

The general purpose of the present invention, which will be described subsequently in greater detail, is to provide a new face painting stencils apparatus and method which has many of the advantages of the face painting tools and accessories mentioned heretofore and many novel features that result in a new face painting stencils which is not anticipated, rendered obvious, suggested, or even implied by any of the prior art face painting tools and accessories, either alone or in any combination thereof.

To attain this, the present invention generally comprises a card having substantially planar first and second surfaces, a pair of end edges and a pair of side edges extending between the end edges of the card. The card has at least one hole therethrough extending between the first and second surfaces of the card.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new face painting stencils apparatus and method which has many of the advantages of the face painting tools and accessories mentioned heretofore and many novel features that result in a new face painting stencils which is not anticipated, rendered obvious, suggested, or even implied by any of the prior art face painting tools and accessories, either alone or in any combination thereof.

It is another object of the present invention to provide a new face painting stencils which may be easily and efficiently manufactured and marketed.

It is a further object of the present invention to provide a new face painting stencils which is of a durable and reliable construction.

An even further object of the present invention is to provide a new face painting stencils which is susceptible of a low cost of manufacture with regard to both materials and labor, and which accordingly is then susceptible of low prices of sale to the consuming public, thereby making such face painting stencils economically available to the buying public.

Still yet another object of the present invention is to provide a new face painting stencils which provides in the apparatuses and methods of the prior art some of the advantages thereof, while simultaneously overcoming some of the disadvantages normally associated therewith.

Still another object of the present invention is to provide a new face painting stencils for helping paint images, logos and other designs on the face of a user.

Yet another object of the present invention is to provide a new face painting stencils which includes a card having substantially planar first and second surfaces, a pair of end edges and a pair of side edges extending between the end edges of the card. The card has at least one hole therethrough extending between the first and second surfaces of the card.

Still yet another object of the present invention is to provide a new face painting stencils that allows a user to easily paint complex designs on a face or other parts of the body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
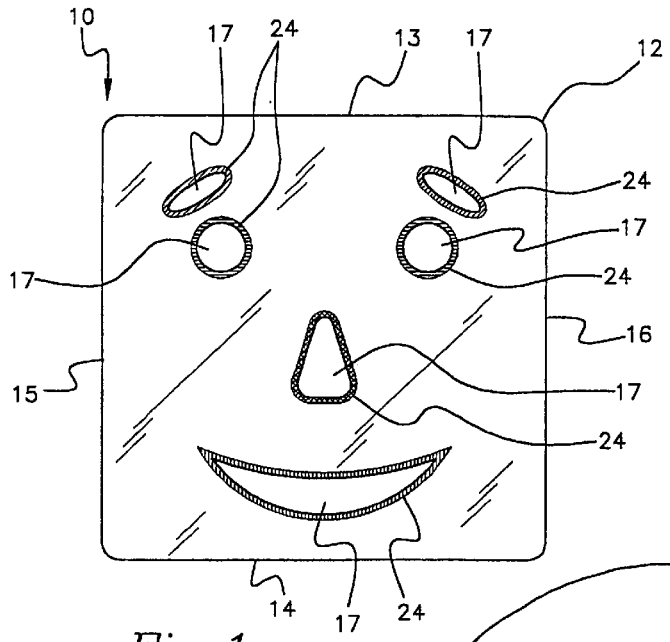
FIG. 1 is a schematic side view of an illustrative embodiment of a new face painting stencils according to the present invention.

With reference now to the drawings, and in particular to FIGS. 1 through 4 thereof, a new face painting stencils embodying the principles and concepts of the present invention and generally designated by the reference numeral 10 will be described.

As best illustrated in FIGS. 1 through 4, the face painting stencils 10 generally comprises a card 12 having substantially planar first and second surfaces, a pair of end edges 13, 14 and a pair of side edges 15, 16 extending between the end edges 13, 14 of the card 12. The card 12 has at least one hole 17 therethrough extending between the first and second surfaces of the card 12.

In use, the stencil 10 is designed for aiding the application of a design on the skin 23 of a wearer. In closer detail, the card 12 is preferably generally rectangular and ideally square in shape. The card 12 has substantially planar first and second surfaces, a pair of end edges 13, 14 and a pair of side edges 15, 16 extending between the end edges 13, 14 of the card 12. Preferably, the card 12 is flexible to permit placement of one of the surfaces of the card 12 against a surface of the skin of a wearer to conform with the contours of the surface of the skin 23 of the wearer. Ideally, the card 12 comprises a flexible plastic. In the ideal embodiment, the card 12 has rounded corners to help prevent scratching of the skin of a wearer when the card 12 is placed against the skin of the wearer. In an illustrative ideal embodiment, the card 12 has length and width dimensions of each about 3 inches.

Figure 2:
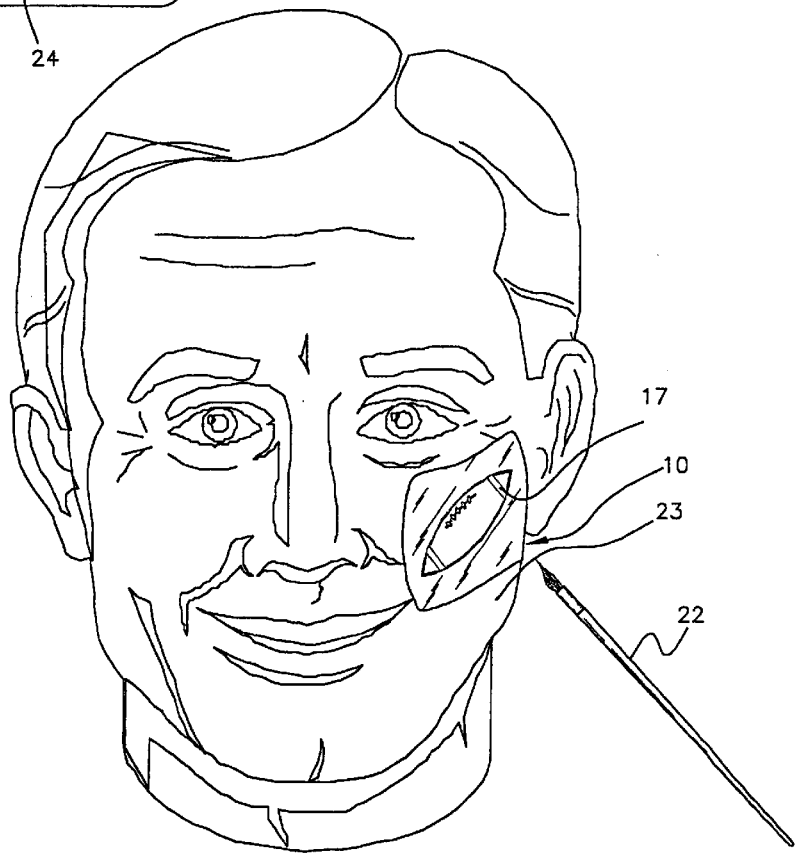
FIG. 2 is a schematic side view of the present invention in use for painting an image on the skin of a wearer.
Figure 3:
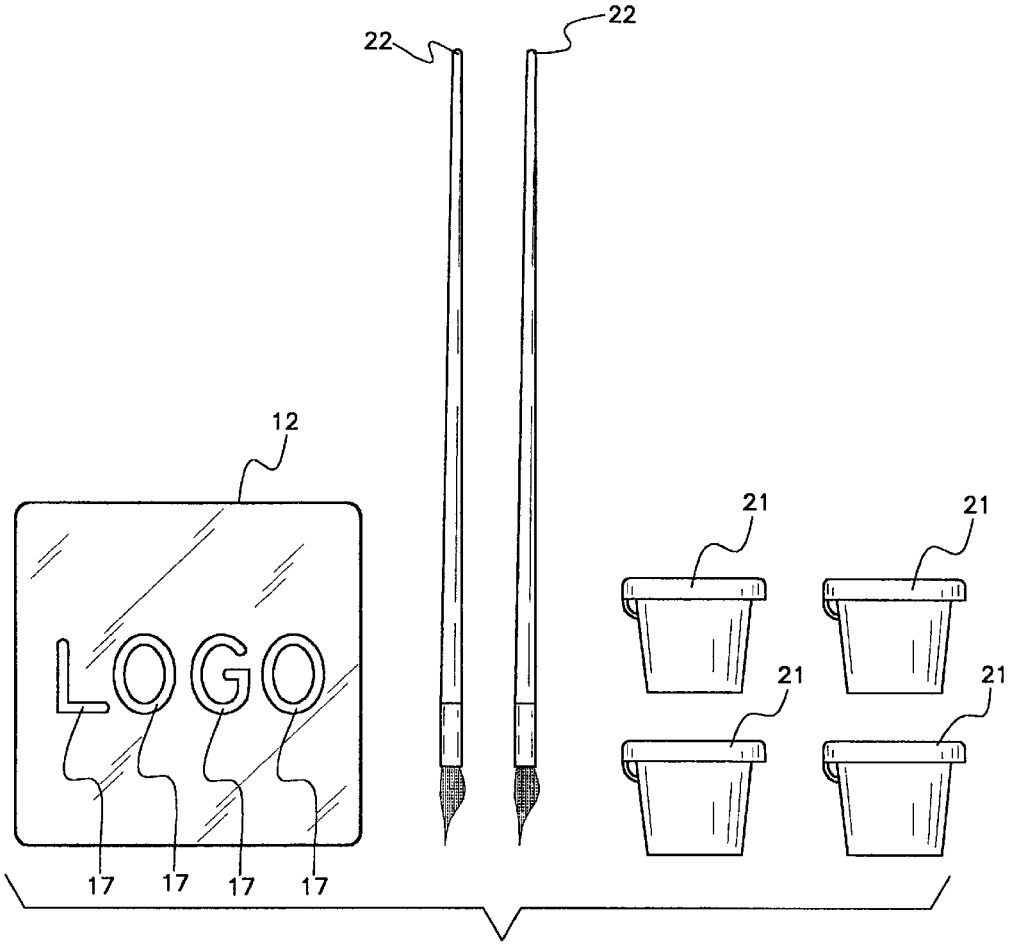
FIG. 3 is a schematic view of the present invention in a kit with paint and paint brushes.
Figure 4:
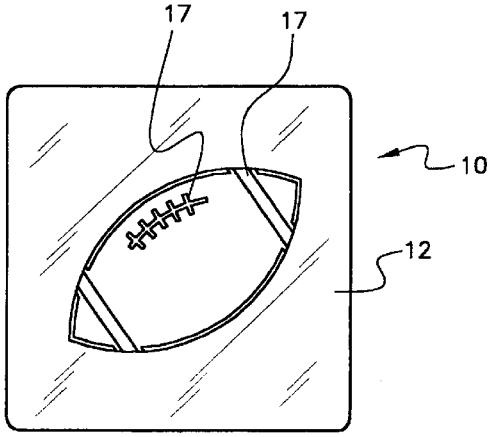
FIG. 4 is a schematic side view of an illustrative embodiment of the present invention.

The card 12 has at least one hole 17 therethrough extending between the first and second surfaces of the card 12. The hole 17 has an outer periphery. The first surface of the card 12 preferably has a coding band 24 around the outer periphery of each of the holes of the card 12 as shown in FIG. 1. The coding band 24 is color coded to indicate the color of paint to be applied to the skin of a wearer exposed in the hole 17 when the card 12 is placed against the skin of the wearer as illustrated in FIG. 2. As illustrated in FIG. 3, the outer periphery of the holes 17 through the card may be formed to resemble the outline of an alpha-numeric character so that names and slogans may be painted on the skin of a wearer. As illustrated in FIGS. 1, 2, and 4, the outer periphery of the holes 17 may also is formed to resemble the outline of an image such as a team logo or symbol may be displayed on the skin of a wearer.

In use, as illustrated in FIG. 2, one of the surfaces of the stencil is placed against the surface of the skin so that the card 12 conforms to the contours of the surface of the skin. Paint 21 is applied to the skin exposed in the hole of the card 12 of the stencil. Preferably, the paint is applied to the surface of the skin using a paint brush 22. Even more preferably, the paint is applied to the skin of a wearer according to the color of the coding band 24 around the outer periphery of the particular hole being painted. Ideally, as illustrated in FIG. 3, the stencil may be provided in a kit having different colored paint is kept in several paint containers 3 and at least one paint brush. After the skin exposed in the hole is painted with the appropriate color, the stencil is then removed from the surface of the skin of a user to display the painted design on the skin. Optionally, several stencils may be used to paint over the same area of skin to achieve multi-colored designs such as done in multi-colored silk screening by overlaying subsequent stencils with deferent parts of the overall image over the painted skin and painting the skin in the holes of the new stencil with a color different than the color used with the first stencil.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stencil kit for aiding the application of a design on skin of a wearer, said stencil kit comprising:

a plurality of brushes each with an elongated linear handle which tapers from a first end to a second end wherein bristles are attached to the first end;

a plurality of paint canisters each having a side wall and a peripheral lip with a closed loop handle extending downwardly between the peripheral lip and the side wall;

a card being generally rectangular and having substantially planar first and second surfaces, a pair of end edges and a pair of side edges extending between said end edges of said card, wherein said card is flexible to permit placement of one of said surfaces of said card against a surface of the skin of a wearer to conform with the contours of the surface of the skin of the wearer, wherein said card comprises a flexible plastic;

wherein said card has rounded corners to help prevent scratching of the skin of the wearer when the card is placed against the skin of the wearer;

wherein said card is generally square in shape and has length and width dimensions both of about 3 inches;

said card having a plurality of holes therethrough extending between said first and second surfaces of said card, each of said holes having an outer periphery; and wherein said outer periphery of at least one of said holes is formed to resemble the outline of an image;

wherein said first surface of said card has a coding band around the outer periphery of each of said holes of said card, said coding band being color coded to indicate the color of paint to be applied to the skin of the wearer exposed in the hole when said card is placed against the skin of the wearer.

2. A stencil kit as set forth in claim 1 wherein the image comprises an alpha-numeric character.

3. A stencil kit as set forth in claim 1 wherein the image comprises an outer peripheral outline of a football.

4. A stencil kit as set forth in claim 1 wherein the image comprises an outer peripheral outline of facial features including a mouth, a nose, two eyes, and two oval-shaped eyebrows.

5. A stencil kit as set forth in claim 1 wherein the image comprises an comprises an alpha-numeric character, an outer peripheral outline of a football, an outer peripheral outline of facial features including a mouth, a nose, two eyes, and two oval-shaped eyebrows.

* * * * *